US009996030B2

(12) United States Patent
Kainuma et al.

(10) Patent No.: US 9,996,030 B2
(45) Date of Patent: Jun. 12, 2018

(54) TONER CASE AND IMAGE FORMING APPARATUS INCLUDING THE SAME

(71) Applicant: KYOCERA Document Solutions Inc., Osaka (JP)

(72) Inventors: Takashi Kainuma, Osaka (JP); Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/498,562

(22) Filed: Apr. 27, 2017

(65) Prior Publication Data

US 2017/0343927 A1 Nov. 30, 2017

(30) Foreign Application Priority Data

May 26, 2016 (JP) ..... 2016-105523

(51) Int. Cl.
*G03G 15/08* (2006.01)

(52) U.S. Cl.
CPC ..... *G03G 15/0886* (2013.01)

(58) Field of Classification Search
CPC ..... G03G 15/0886; G03G 2215/067; G03G 2215/0692; G03G 2221/1612
See application file for complete search history.

(56) References Cited

U.S. PATENT DOCUMENTS

2011/0280610 A1* 11/2011 Itabashi ..... G03G 15/0875 399/102
2015/0153682 A1* 6/2015 Okubo ..... G03G 15/0886 399/258
2017/0097587 A1* 4/2017 Inada ..... G03G 15/0886

FOREIGN PATENT DOCUMENTS

JP 2012-118281 A 6/2012

* cited by examiner

*Primary Examiner* — Rodney Bonnette
(74) *Attorney, Agent, or Firm* — Studebaker & Brackett PC

(57) ABSTRACT

A toner case includes a case main body, a shutter mount and a shutter. The case main body contains a toner to be replenished to a development device provided in an apparatus main body and is detachably attached to the apparatus main body. The case main body has an opened face on which a discharge port is arranged and the discharge port corresponds to a replenishment port of the development device in a state where the case main body is attached to the apparatus main body. The shutter mount is provided to form a gap between the opened face of the case main body and the shutter mount. The shutter is provided between the opened face of the case main body and the shutter mount to be slidable to open and close the discharge port. The shutter mount includes a film which comes into sliding contact with the shutter.

10 Claims, 10 Drawing Sheets

TONER CASE AND IMAGE FORMING APPARATUS INCLUDING THE SAME

INCORPORATION BY REFERENCE

This application is based on and claims the benefit of priority from Japanese Patent application No. 2016-105523 filed on May 26, 2016, which is incorporated by reference in its entirety.

BACKGROUND

The present disclosure relates to a toner case suitably used for a copying machine or a printer, and an image forming apparatus including the same.

An image forming apparatus includes a development device which develops a latent image on a photosensitive drum into a toner image. A toner (a developer) to be replenished to the development device is contained in a toner case.

For instance, a toner container is detachably attached to the image forming apparatus in order to supply the toner to the development device. The development device includes a first shutter which is slidable to open and close a toner replenishment port. The development device includes a toner flow rate changing means which changes a flow rate of the toner in an area just below the toner replenishment port to be larger than that in another area. On a lower portion of the toner container, a shutter mounting plate is provided. Between the lower portion of the toner container and the shutter mounting plate, a second shutter is slidably provided. The lower portion of the toner container, the second shutter and the shutter mounting plate each have a toner discharge port. When the toner container is attached to the image forming apparatus, the first and second shutters are moved so as to open the toner replenishment port and the toner discharge ports. On the other hand, when the toner container is detached from the image forming apparatus, the first and second shutters are moved so as to close the toner replenishment port and the toner discharge ports.

SUMMARY

In accordance with a first aspect of the present disclosure, a toner case includes a case main body, a shutter mount and a shutter. The case main body contains a toner to be replenished to a development device provided in an apparatus main body and is detachably attached to the apparatus main body. The case main body has an opened face on which a discharge port is arranged and the discharge port corresponds to a replenishment port of the development device in a state where the case main body is attached to the apparatus main body. The shutter mount is provided so as to form a gap between the opened face of the case main body and the shutter mount. The shutter is provided between the opened face of the case main body and the shutter mount so as to be slidable to open and close the discharge port. The shutter mount includes a film which comes into sliding contact with the shutter.

In accordance with a second aspect of the present disclosure, a toner case includes a case main body, a shutter mount and a shutter. The case main body contains a toner and has an opened face on which a discharge port is arranged. The shutter mount is provided so as to form a gap between the opened face of the case main body and the shutter mount. The shutter is provided between the opened face of the case main body and the shutter mount so as to be slidable to open and close the discharge port. The shutter mount has a film which comes into sliding contact with the shutter.

In accordance with the first aspect of the present disclosure, an image forming apparatus includes the toner case according to the first aspect.

In accordance with the second aspect of the present disclosure, an image forming apparatus includes the toner case according to the second aspect.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described.

Figure 1:
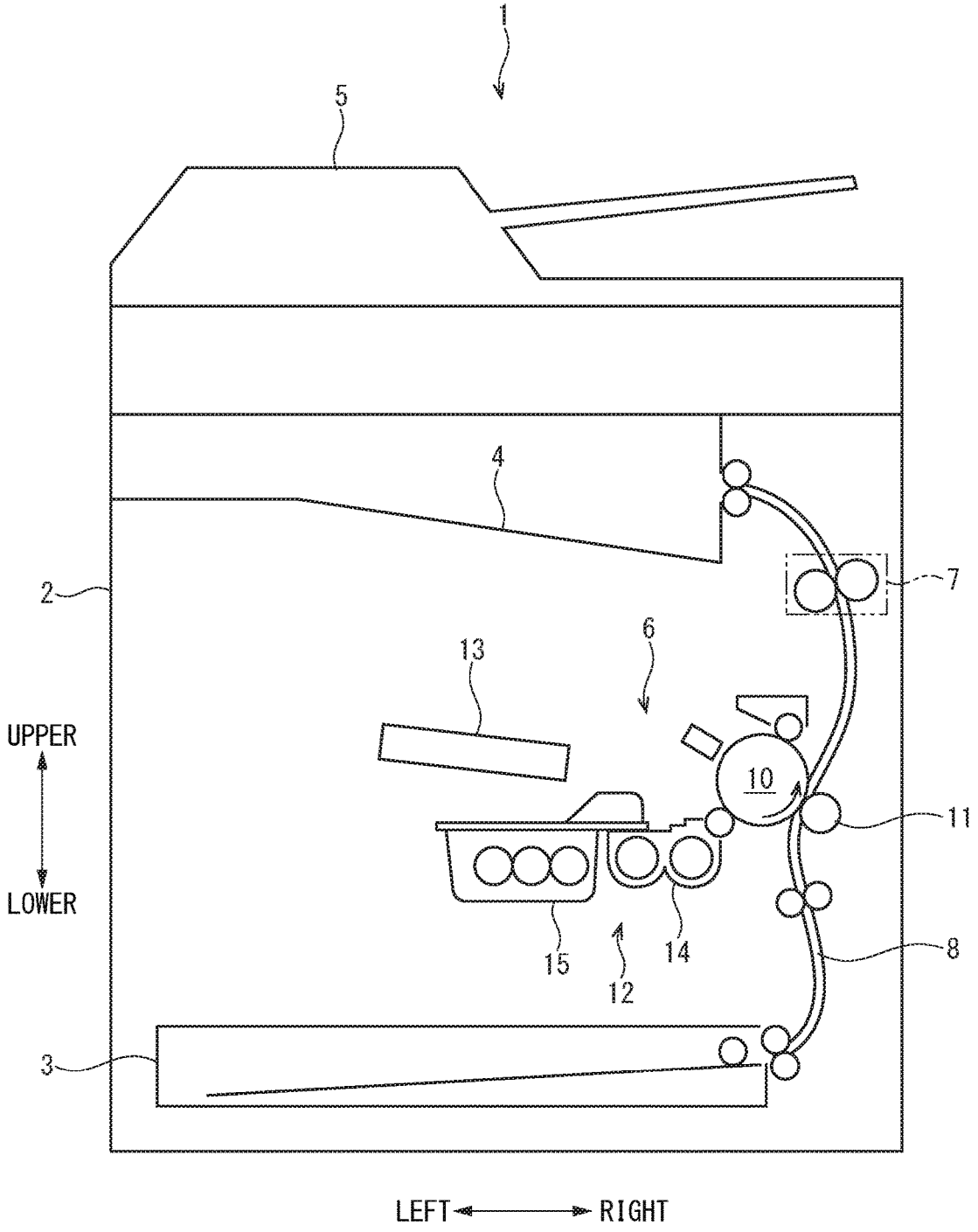
FIG. 1 is a sectional view schematically showing an inner structure of an image forming apparatus according to an embodiment of the present disclosure.

With reference to FIG. 1, an entire structure of an image forming apparatus 1 will be described. FIG. 1 is a sectional view schematically showing an inner structure of the image forming apparatus 1. In the following descriptions, a near side of the paper plan of FIG. 1 is set as a front side of the image forming apparatus 1, and other directions are based on directions shown in each figure.

The image forming apparatus 1, such as a multifunctional peripheral, prints an image input from an external device on a sheet. The image forming apparatus 1 employs an electrophotographic manner as a printing manner. In a lower portion of an apparatus main body 2 of the image forming apparatus 1, a sheet feeding cassette 3 is provided. In an upper portion of the apparatus main body 2, an ejection tray 4 is provided. Above the ejection tray 4, an image reading part 5 which reads image information on a document is provided. The image forming apparatus 1 may be a printer, a copying machine, a facsimile or the like.

The image forming apparatus 1 includes an image forming part 6 and a fixing device 7 in the apparatus main body 2. The image forming part 6 is disposed on the middle of a conveying path 8 extending from the sheet feeding cassette 3 to the ejection tray 4. The fixing device 7 is disposed on a downstream side of the conveying path 8.

The image forming part 6 includes a photosensitive drum 10, a transferring roller 11, a toner supplying device 12 and an optical scanning device 13. The transferring roller 11 comes into contact with the photosensitive drum 10 to form a transferring nip. The toner supplying device 12 has a development device 14, a toner container 15 and the others, as described later in detail. The toner container 15 as an example of a toner case contains a toner (a developer). The development device 14 is supplied with the toner from the toner container 15. As the toner, a one-component developer including a magnetic toner is used.

The toner container 15 is arranged at a left side of the development device 14. The optical scanning device 13 is arranged above the toner container 15. The optical scanning device 13 exposes the photosensitive drum 10 to form a latent image. The development device 14 develops the latent image on the photosensitive drum 10 into a toner image using a toner supplied from the toner container 15. The toner image carried on the photosensitive drum 10 is transferred on the sheet passing through the transferring nip and then fixed on the sheet by the fixing device 7. After that, the sheet is ejected toward the ejection tray 4.

Figure 2:
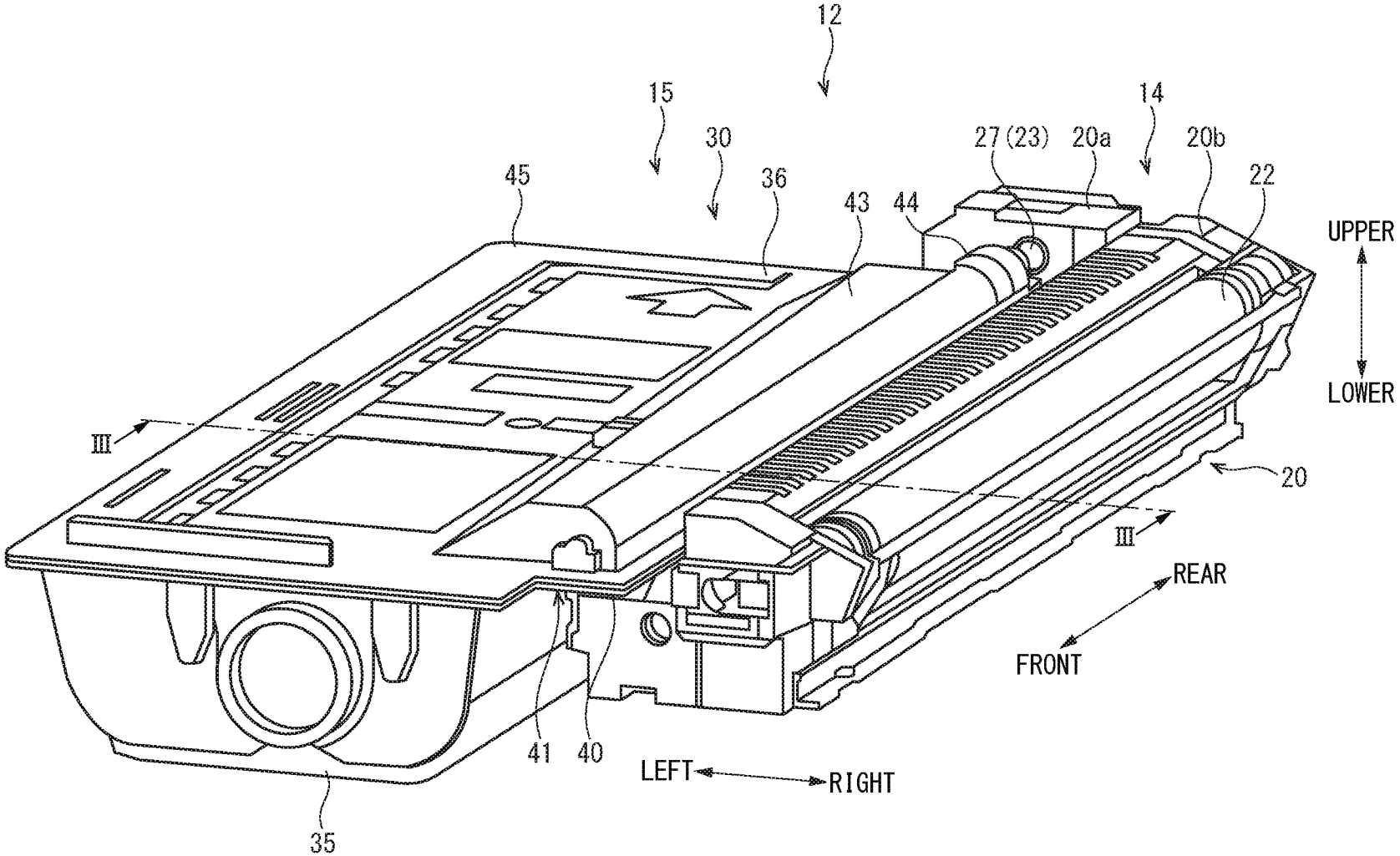
FIG. 2 is a perspective view showing a toner supplying device according to the embodiment of the present disclosure.
Figure 3:
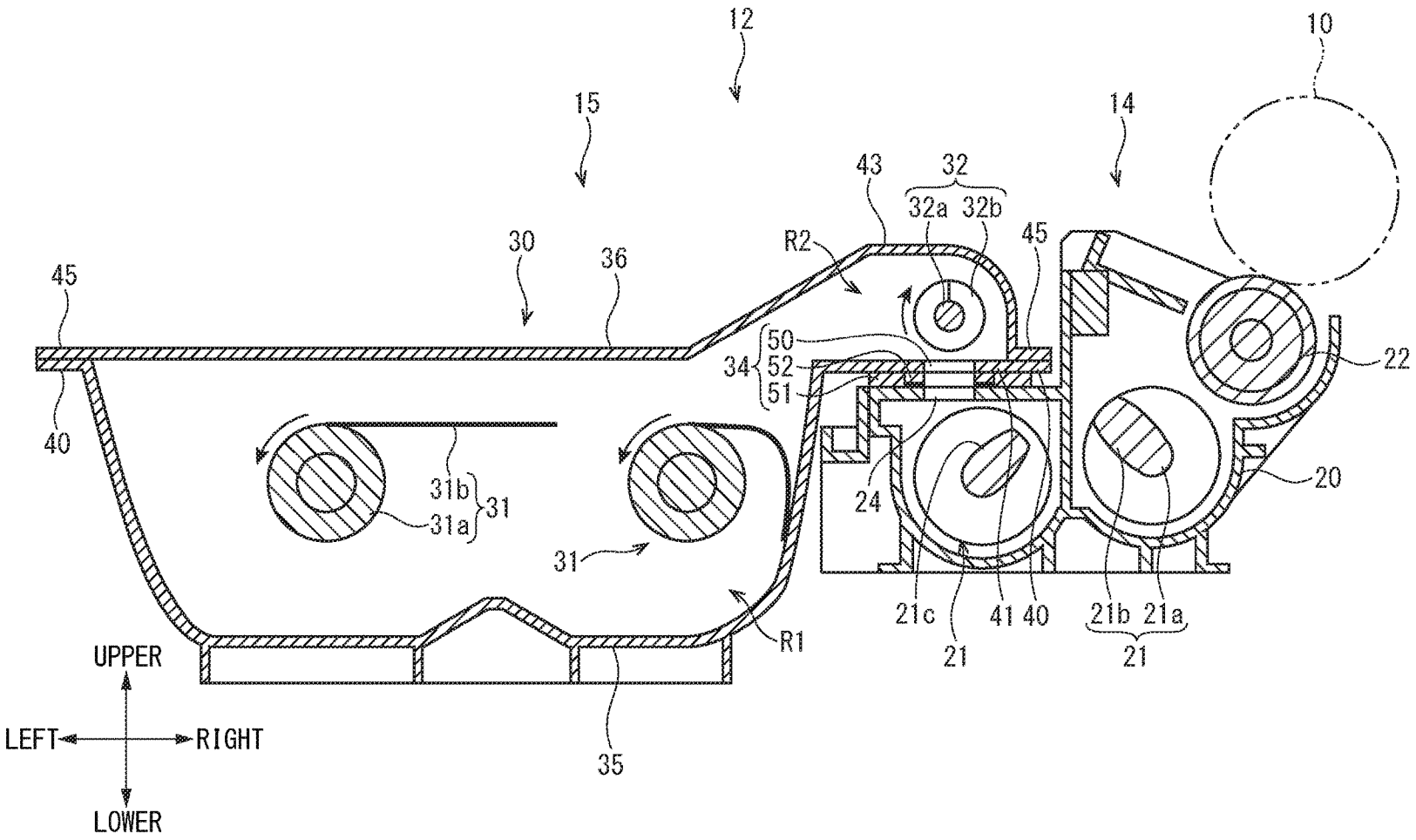
FIG. 3 is a sectional view taken along a line of FIG. 2.
Figure 4:
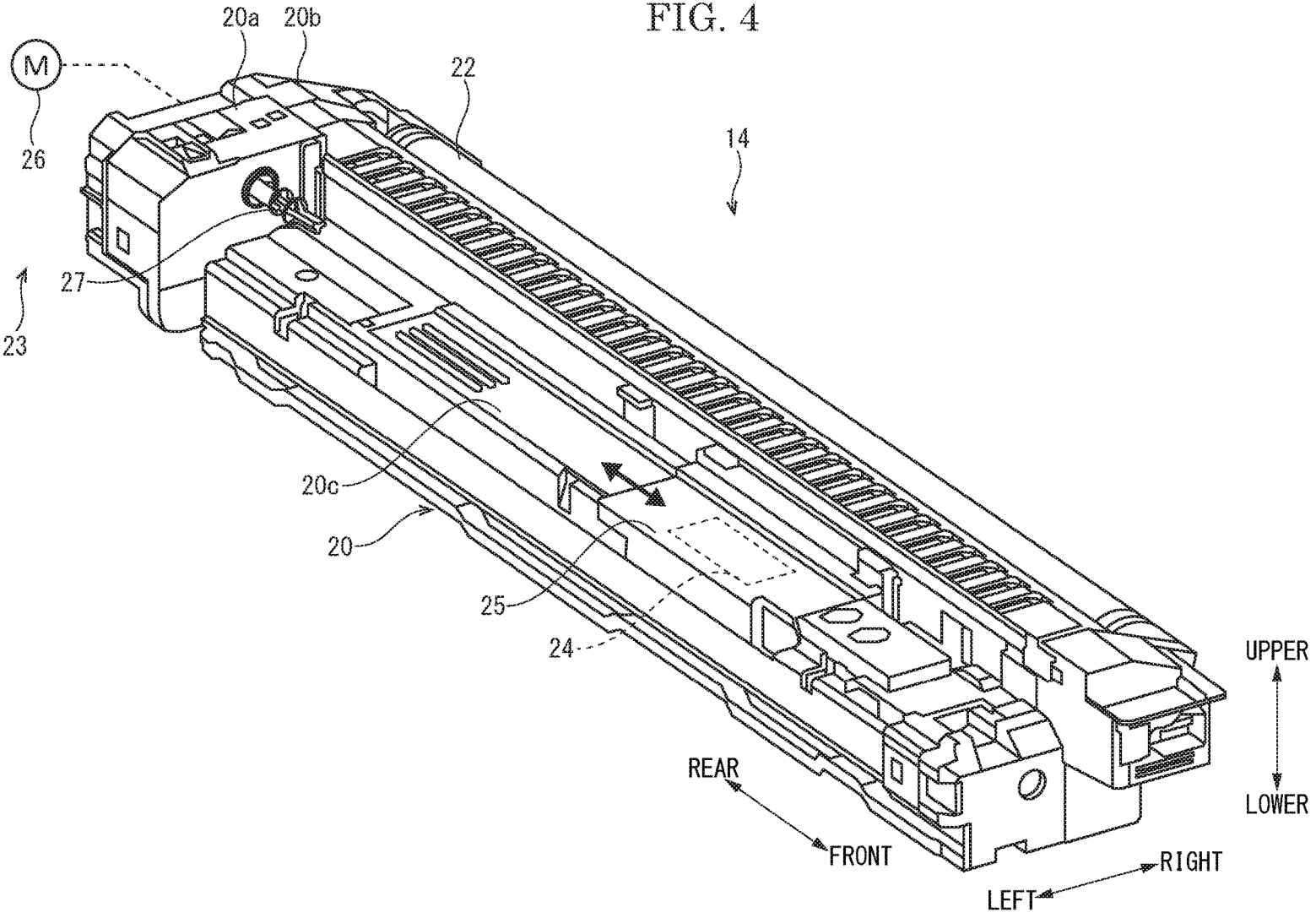
FIG. 4 is a perspective view showing a development device according to the embodiment of the present disclosure.
Figure 5:
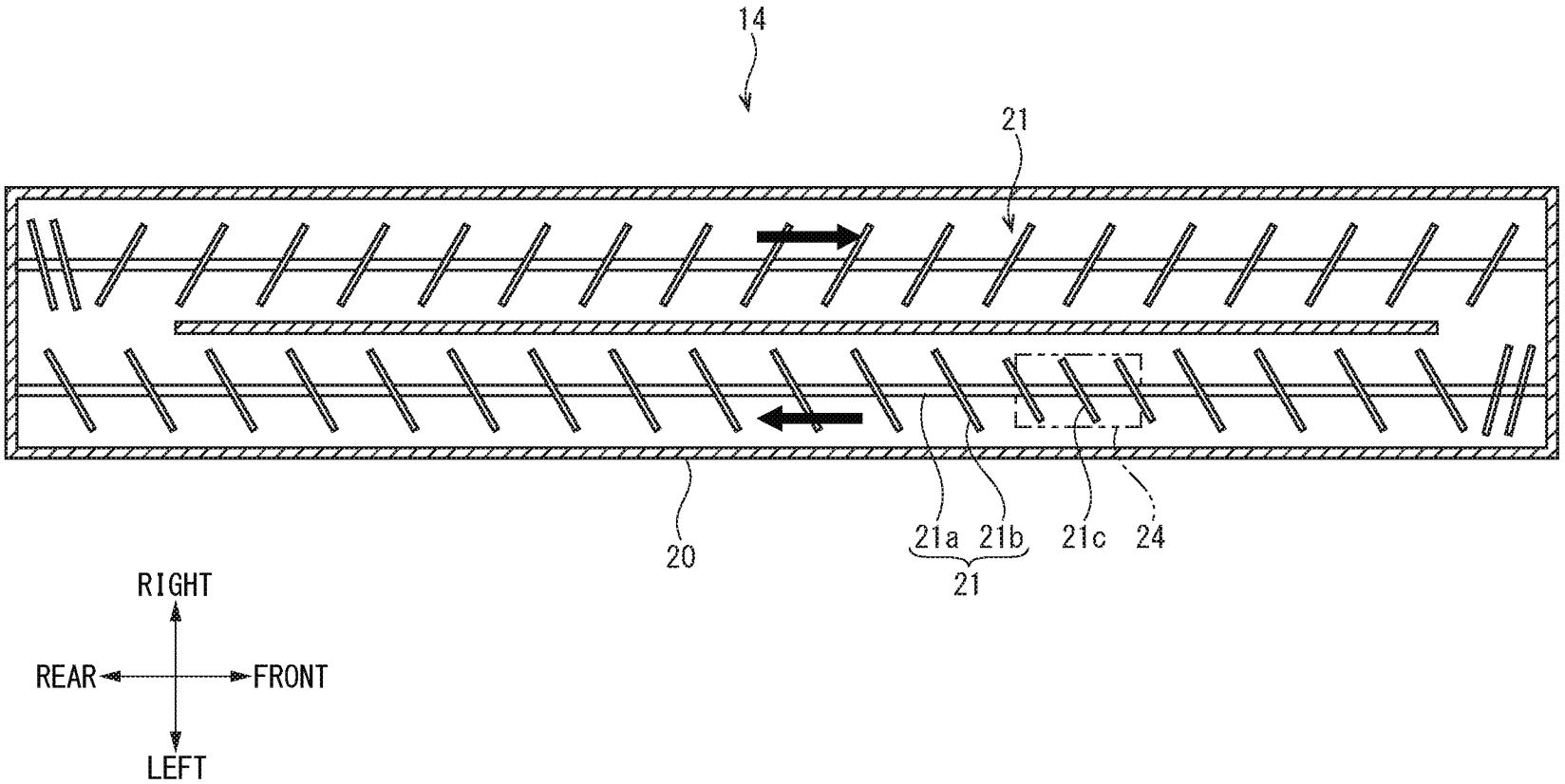
FIG. 5 is a sectional view schematically showing a part of the development device according to the embodiment of the present disclosure.
Figure 6:
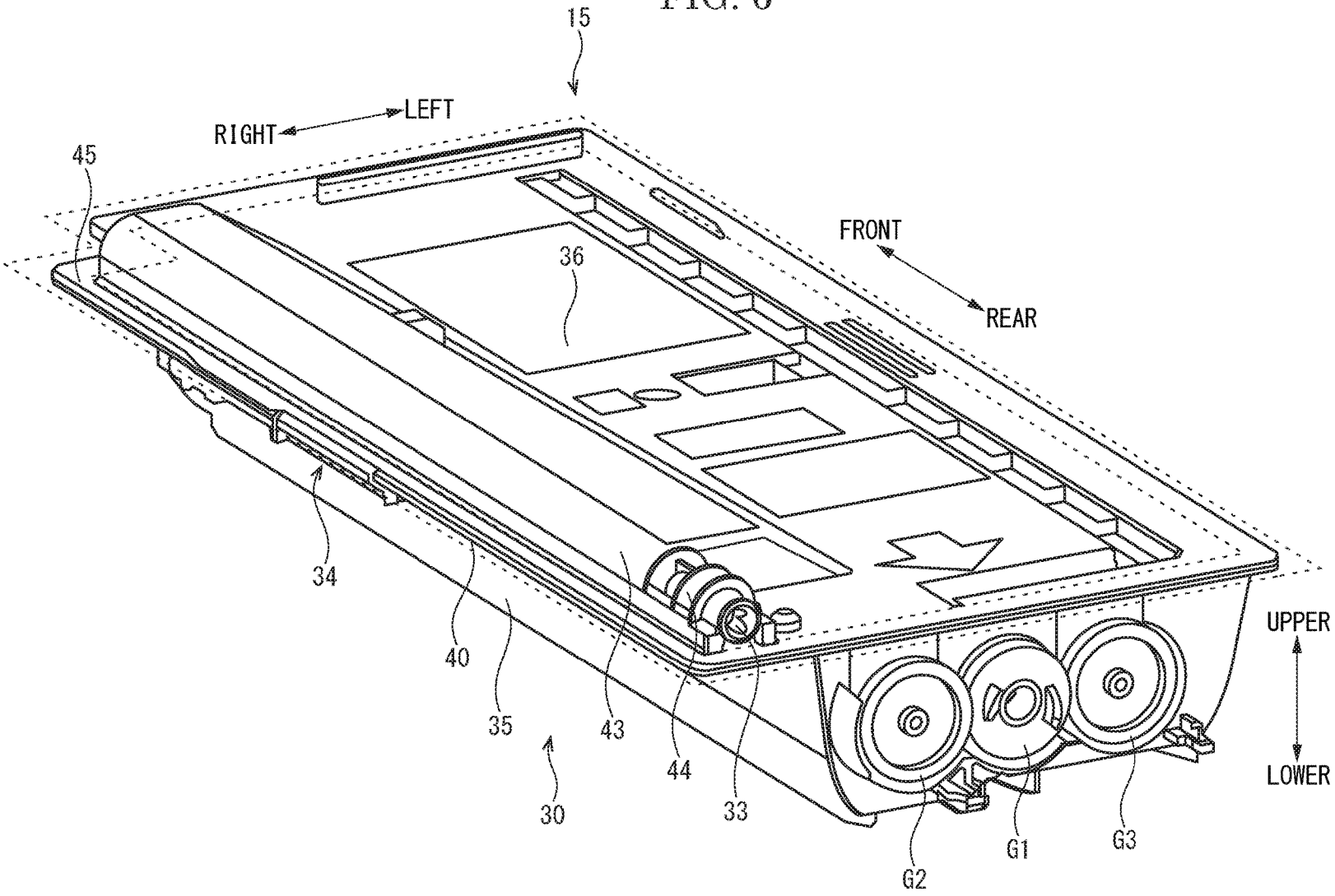
FIG. 6 is a perspective view showing a toner container according to the embodiment of the present disclosure.
Figure 7:
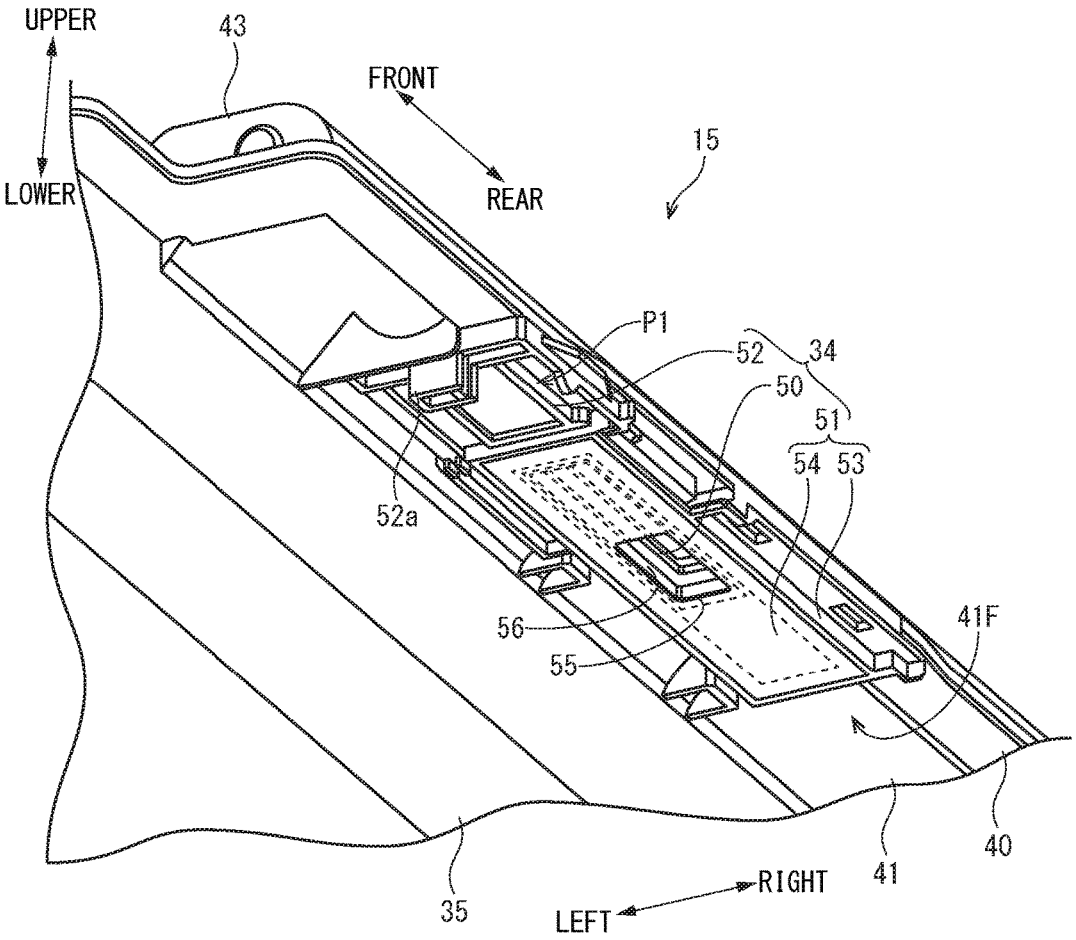
FIG. 7 is a perspective view showing a toner discharge mechanism of the toner container according to the embodiment of the present disclosure.

Next, with reference to FIG. 2 to FIG. 7, the toner supplying device 12 will be described. FIG. 2 is a perspective view showing the toner supplying device 12. FIG. 3 is a sectional view taken along a line III-III of FIG. 2. FIG. 4 is a perspective view showing the development device 14. FIG. 5 is a sectional view schematically showing a part of the development device 14. FIG. 6 is a perspective view showing the toner container 15. FIG. 7 is a perspective view showing a toner discharge mechanism 34 of the toner container 15.

As shown in FIG. 2, the toner supplying device 12 includes the development device 14 and the toner container 15. The toner container 15 is detachably attached to the apparatus main body 2. The development device 14 and the toner container 15 are adjacently arranged side by side. This arrangement makes the toner supplying device 12 lower in height. Accordingly, even if the optical scanning device 13 is arranged above the toner container 15, it becomes possible to make the image forming apparatus 1 (the apparatus main body 2) small in size (refer to FIG. 1).

As shown in FIG. 2 to FIG. 4, the development device 14 includes a housing 20, development screws 21, a development roller 22 and a development drive mechanism 23.

The housing 20 is formed into a box-shape elongated in the front and rear direction, and made of synthetic resin, for example. In the housing 20, the toner replenished from the toner container 15 is contained. On an upper portion of the housing 20, a rear side protruded part 20*a* and a right side protruded part 20*b* are formed. As shown in FIG. 4, on a left upper face of the housing 20, a connecting face 20*c* made lower by one step than each of the protruded parts 20*a* and 20*b* is formed. In the connecting face 20*c* of the housing 20, a replenishment port 24 through which the toner is supplied from the toner container 15 is formed. Around the replenishment port 24, a seal (not shown) made of rubber, for example, is provided.

On the connecting face 20*c*, a replenishment port shutter 25 which opens and closes the replenishment port 24 is provided. The replenishment port shutter 25 is supported by the housing 20 so as to be slidable in the front and rear direction to open and close the replenishment port 24. The replenishment port shutter 25 is biased by a replenishment side biasing member (not shown) to a direction in which the replenishment port 24 is closed.

As shown in FIG. 3 and FIG. 5, the two development screws 21 each have a development shaft 21*a* extending in the front and rear direction and a development blade 21*b* spirally fixed around a circumferential face of the development shaft 21*a*. The two development screws 21 are arranged in the housing 20 side by side in the left and right direction. The development shaft 21*a* of each development screw 21 is rotatably supported by the housing 20. The two development screws 21 are provided in order to agitate and circulate the toner in the housing 20 (refer to arrows in FIG. 5). The development screw 21 arranged under the connecting face 20*c* has a small diameter blade 21*c* positioned right below the replenishment port 24. The small diameter blade 21*c* has a diameter smaller than that of the development blade 21*b* positioned under another area.

As shown in FIG. 2 to FIG. 4, the development roller 22 is formed into a cylindrical shape elongated in the front and rear direction. The development roller 22 is supported in the right side protruded part 20*b* so as to be rotatable in a state where a part of the development roller 22 is exposed. The toner in the housing 20 adheres to the development roller 22 and then is transferred on the photosensitive drum 10 to form the toner image.

As shown in FIG. 4, the development drive mechanism 23 includes a drive shaft (not shown), a drive motor 26 and a development side joint 27.

The drive shaft is provided in the rear side protruded part 20*a* so as to be rotatable. The drive motor 26 is connected to the drive shaft via a gear train (not shown). Drive force (rotation) of the drive motor 26 is transmitted to the development roller 22 and the development screws 21 via a plurality of gears (not shown). The development side joint 27 is provided at a front end portion of the drive shaft. The development side joint 27 is connected to the drive shaft in a state where the development side joint 27 is allowed to be inclined with respect to a rotation center of the drive shaft (the detail description is omitted).

As shown in FIG. 2, FIG. 3 and FIG. 6, the toner container 15 includes a case main body 30, two agitating members 31, a conveying screw 32, a case side joint 33 and a toner discharge mechanism 34.

The case main body 30 is formed into a box-shape, and made of thermoplastic resin, for example. The case main body 30 is formed so as to be capable of containing the toner to be replenished to the development device 14 and being detachably attached to the apparatus main body 2. The case main body 30 includes a case 35 and a lid 36.

The case 35 is formed into a bathtub-like shape elongated in the front and rear direction. Inside the case 35, a toner storage room R1 in which the toner is contained is formed (refer to FIG. 3). Around a circumferential edge portion of an upper face opening of the case 35, a case side bonded area 40 is formed (refer to a dashed line in FIG. 6). The case side bonded area 40 is formed into a flange-shape extending outward from four upper edges of the case 35. The right side case side bonded area 40 is formed on a tip side of a connecting flange portion 41 extending rightward from a right upper edge of the case 35 (refer to FIG. 3). That is, a width of one flange-shape formed at a right edge is wider than that of another flange-shape formed at another edge.

The toner container 15 (the case main body 30) is attached to a predetermined position of the apparatus main body 2. In this state, the right side case side bonded area 40 and the connecting flange portion 41 are overlapped with the connecting face 20*c* of the development device 14 (refer to FIG. 2 to FIG. 4).

The lid 36 covers the upper face opening of the case 35 to seal the case 35. Around a circumferential portion of the lid 36, a lid side bonded area 45 which is ultrasonic-welded to the case side bonded area 40 is formed (refer to the dashed line in FIG. 6).

The lid 36 is integrally formed with a rotator storage 43 and a joint storage 44. The rotator storage 43 is swelled upward from a right side portion of the lid 36. As shown in FIG. 3, a lower face of the rotator storage 43 is opened. In a right side portion of an inside of the rotator storage 43, a screw arrangement room R2 in which the conveying screw 32 is stored is formed. As shown in FIG. 2 and FIG. 6, the joint storage 44 is connected to a rear end portion of the rotator storage 43. In an inside of the joint storage 44, the case side joint 33 is stored, as described later.

The rotator storage 43 and the joint storage 44 are formed inside the circumferential portion of the lid 36 so as to avoid the lid side bonded area 45 (refer to FIG. 5). In a state where the lid 36 is bonded to the case 35, the rotator storage 43 and the joint storage 44 are arranged on an upper face of the connecting flange portion 41. The screw arrangement room R2 is communicated with the toner storage room R1 (refer to FIG. 3).

Each of the two agitating members 31 has an agitating shaft 31*a* extending in the front and rear direction and a flexible agitating piece 31*b* fixed to the agitating shaft 31*a*. Each agitating member 31 is supported by the case 35 so as to be rotatable. Each agitating piece 31*b* extends from the agitating shaft 31*a* outward in a radial direction so as to come into sliding contact with an inner wall face of the case main body 30. On a rear side face of the case 35, an intermediate gear G1 connected to the drive motor 26 is provided (refer to FIG. 6). A rear end portion of each agitating member 31 penetrates through the case 35. To the rear end portions of the two agitating members 31, two output gear G2 and G3 which are meshed with the intermediate gear G1 are fixed (refer to FIG. 6).

As shown in FIG. 3, the conveying screw 32 has a conveying shaft 32*a* extending in the front and rear direction and a conveying blade 32*b* spirally fixed around a circumferential of the conveying shaft 32*a*. The conveying screw 32 is supported by the rotator storage 43 so as to be rotatable in a posture parallel with the case side bonded area 40 and the others. A rear end portion of the conveying shaft 32*a* extends in the inside of the joint storage 44.

As shown in FIG. 6, the case side joint 33 is formed so as to be able to being detachably attached to the rear end portion of the conveying screw 32 in the inside of the joint storage 44. The case side joint 33 is engaged with the development side joint 27 so that the drive shaft is connected to the conveying screw 32 (the detail description is omitted). Thereby, the drive force of the drive motor 26 is transmitted to the conveying screw 32.

As shown in FIG. 6 and FIG. 7, the toner discharge mechanism 34 is provided in the connecting flange portion 41 in order to discharge the toner in the case main body 30 toward the development device 14. The toner discharge mechanism 34 includes a discharge port 50, a shutter mount 51 and a discharge port shutter 52 (a shutter).

As shown in FIG. 7, the discharge port 50 is formed in the connecting flange portion 41 so as to correspond to the replenishment port 24 of the development device 14 in a state where the case main body 30 is attached to the apparatus main body 2 (refer to FIG. 3). The discharge port 50 is a substantially rectangular shaped opening formed at a rear side portion of the connecting flange portion 41, as viewed from its bottom face. Through the discharge port 50, the toner contained in the case main body 30 is discharged.

The shutter mount 51 is provided so as to be separated from a lower face 41F (an opened face of the case main body 30) of the connecting flange portion 41 on which the discharge port 50 is arranged. That is, between the lower face 41F of the connecting flange portion 41 and the shutter mount 51, a gap is formed. The shutter mount 51 includes a mount frame part 53 and a film 54.

The mount frame part 53 is formed into a substantially rectangular frame shape, and made of acrylonitrile-butadiene-styrene (ABS) resin, for example. The mount frame part 53 is provided along the lower face 41F of the connecting flange portion 41 so as to surround the discharge port 50.

The film 54 is formed into a substantially rectangular shape, and made of polyethylene terephthalate (PET), for example. The film 54 is formed into a thin membrane having a thickness of about 0.1 mm, for example. The film 54 is arranged so as to cover a hollow space of the mount frame part 53. The film 54 is fixed to the mount frame part 53 by using a double-sided adhesive tape or the like. The film 54 has a mount side opening 55 of a substantially rectangular shape, as viewed from its bottom face. The mount side opening 55 is opened to the film 54 at a position corresponding to the discharge port 50.

The discharge port shutter 52 is formed into a substantially rectangular shaped plate, and made of ABS resin, for example. The discharge port shutter 52 is provided between the lower face 41F of the connecting flange portion 41 and the shutter mount 51 (the film 54) so as to be slidable. That is, the discharge port shutter 52 is arranged so as to slide on an upper face of the film 54. The discharge port shutter 52 is movable between an opening position P1 where the discharge port shutter 52 opens the discharge port 50 and a closing position P2 where the discharge port shutter 52 closes the discharge port 50 (refer to FIG. 8). The discharge port shutter 52 is biased to the closing position P2 by a discharge side biasing member (not shown).

The discharge port shutter 52 has a shutter side opening 56 facing the discharge port 50 in a state where the discharge port shutter 52 is moved to the opening position P1. The shutter side opening 56 is an opening having a substantially rectangular shape, as viewed from its bottom face. The above described mount side opening 55 of the film 54 is formed so as to face the shutter side opening 56 in a state where the discharge port shutter 52 is moved to the opening position P1.

Figure 8:
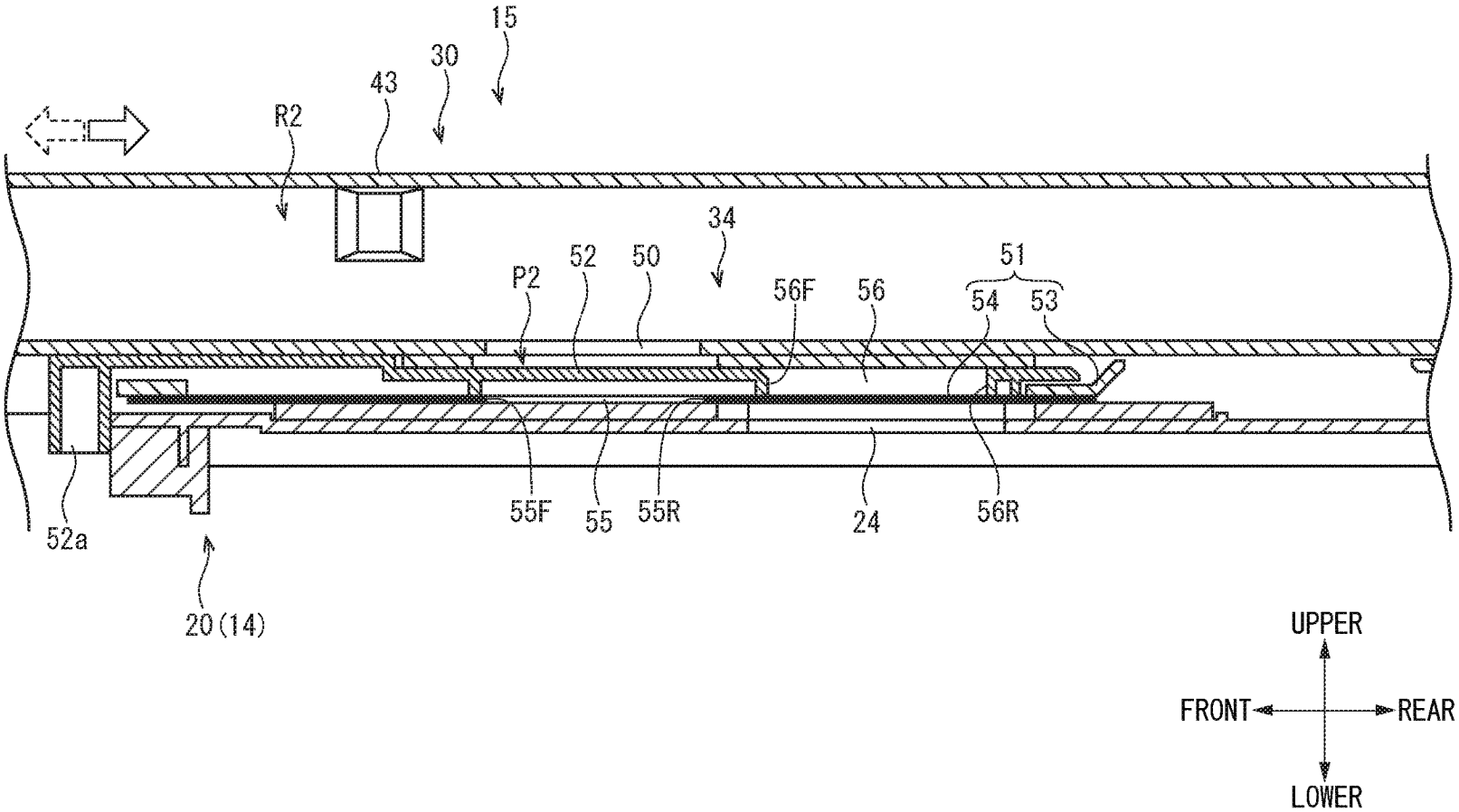
FIG. 8 is a sectional view showing a state where a discharge port shutter is moved to a closing position, in the toner container according to the embodiment of the present disclosure.
Figure 9:
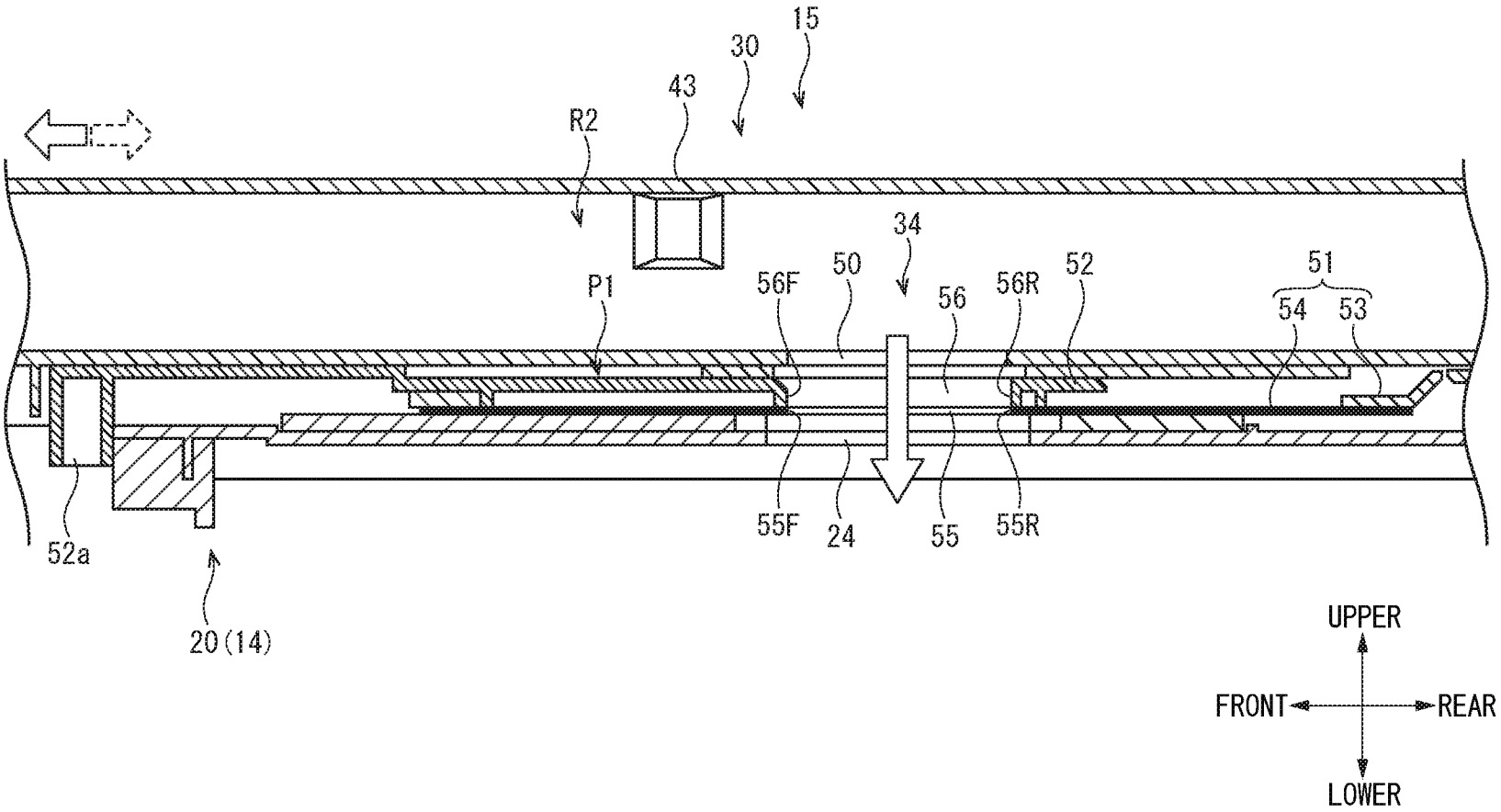
FIG. 9 is a sectional view showing a state where the discharge port shutter is moved to an opening position, in the toner container according to the embodiment of the present disclosure.

Next, with reference to FIG. 8 and FIG. 9, an operation of the toner supplying device 12 will be described. FIG. 8 is a sectional view showing a state where the discharge port shutter 52 is moved to the closing position P2. FIG. 9 is a sectional view showing a state where the discharge port shutter 52 is moved to the opening position P1.

First, in a state where the toner container 15 is detached from the apparatus main body 2 (anon-attachment state), the replenishment port shutter 25 of the development device 14 closes the replenishment port 24. On the other hand, in the state, the discharge port shutter 52 of the toner container 15 is moved to the closing position P2 to close the discharge port 50.

Subsequently, the toner container 15 (the case main body 30) is pushed rearward from a front side of the apparatus main body 2 and attached to the predetermined position of the apparatus main body 2 (refer to a white arrow (a solid line) in FIG. 8). In a process where the toner container 15 is attached to the apparatus main body 2, a rear end portion of the shutter mount 51 comes into contact with the replenishment port shutter 25 (not shown). As the attachment of the toner container 15 proceeds, the replenishment port shutter 25 slides rearward. That is, the replenishment port shutter 25 moves rearward so as to open the replenishment port 24.

From this state, as the attachment operation of the toner container 15 proceeds, a projected portion 52*a* formed in a front end portion of the discharge port shutter 52 comes into contact with a part of the connecting face 20*c* of the development device 14 (refer to FIG. 8). As the attachment operation of the toner container 15 proceeds further, the discharge port shutter 52 is relatively slid forward. That is, the discharge port shutter 52 is moved from the closing position P2 to the opening position P1 to open the discharge port 50 (refer to FIG. 9).

As described above, the toner container 15 is attached to the predetermined position of the apparatus main body 2. In this state, the discharge port 50, the shutter side opening 56 and the mount side opening 55 are aligned each other (refer to FIG. 9). In this state, the case side joint 33 of the toner container 15 is coupled to the development side joint 27 of the development device 14 (refer to FIG. 2).

In a state where the toner container 15 is coupled to the development device 14, the drive motor 26 starts to drive. The drive motor 26 rotates the conveying screw 32 via the joints 27 and 33 and rotates also the two agitating members 31 via the gears G1 to G3 (refer to FIG. 3). Each agitating member 31 flicks the toner contained in the toner storage room R1 toward the screw arrangement room R2. The conveying screw 32 conveys the toner in the screw arrangement room R2 to the discharge port 50. The toner is replenished to the development device 14 (the housing 20) through the discharge port 50, the replenishment port 24 and the others.

The small diameter blade 21*c* of each development screw 21 is arranged just below the replenishment port 24 (refer to FIG. 5). Thereby, conveying force of the toner just below the replenishment port 24 becomes small (weak). Accordingly, an amount of the toner just below the replenishment port 24 becomes larger than that in another area. As a result, the toner replenished from the toner container 15 stays so as to fill an inside of the replenishment port 24. Then, when the development device 14 consumes the toner, the toner is regularly replenished from the toner container 15. As described above, the development device 14 is replenished with the toner from the toner container 15 so as to fill the inside of the replenishment port 24 and keeps an amount of the toner to be contained in the housing 20 constant.

Subsequently, a case where the toner container 15 (the case main body 30) is detached from the apparatus main body 2 will be described briefly. A detachment operation of the toner container 15 is carried out by a reverse operation to the above described attachment operation of the toner container 15. That is, the toner container 15 is pulled out forward and then detached from the predetermined position of the apparatus main body 2 (refer to a white arrow (a dashed line) in FIG. 9).

When the toner container 15 is pulled out from the apparatus main body 2, the case side joint 33 is decoupled from the development side joint 27. The discharge port shutter 52 is biased by the discharge side biasing member to be relatively slid rearward. That is, the discharge port shutter 52 is moved from the opening position P1 to the closing position P2 to close the discharge port 50 (refer to FIG. 8). At this time, the discharge port shutter 52 is relatively moved so as to slide on the upper face of the film 54.

As described above, because the development device 14 is regularly replenished with the toner, the toner stays in the replenishment port 24. Thereby, when the toner container 15 is pulled out, the film 54 moves across the toner stayed in the replenishment port 24. When the discharge port shutter 52 is moved between the opening position P1 and the closing position P2, a front side edge portion 56F of the shutter side opening 56 comes into sliding contact with a rear side edge portion 55R (a front side edge portion 55F according to a sliding distance of the discharge port shutter 52) of the mount side opening 55 (passes closely). A rear side edge portion 56R of the shutter side opening 56 comes into sliding contact with the rear side edge portion 55R of the mount side opening 55 (passes closely). If the shutter mount 51 may come in sliding contact with the discharge port shutter 52 at a thick sliding contact portion, the sliding contact portion may push out the toner stayed in the replenishment port 24.

Regarding this point, according to the toner container 15 of the present embodiment, because the film 54 is like a thin membrane, a large level difference into which the toner is caught is not formed between the discharge port shutter 52 in the closing position P2 (a closing state) and the film 54. Thereby, it becomes possible to prevent the toner from being caught (being held) between the discharge port shutter 52 at the closing state and the film 54.

When the pulling out of the toner container 15 proceeds, the replenishment port shutter 25 is biased by the replenishment side biasing member to be slid forward. That is, the replenishment port shutter 25 is moved forward so as to close the replenishment port 24. Then, the toner container 15 is pulled out from the apparatus main body 2 entirely. As described above, the replenishment port shutter 25 and the discharge port shutter 52 open and close the replenishment port 24 and the discharge port 50 by linking with the attachment and detachment of the toner container 15 to the apparatus main body 2 respectively.

According to the toner container 15 of the present embodiment as described above, the shutter mount 51 comes in sliding contact with the discharge port shutter 52 at the thin sliding contact portion made of a thin membrane like film 54. The discharge port shutter 52 opens the discharge port 50 by linking with the attachment operation of the case main body 30 to the apparatus main body 2 and closes the discharge port 50 by linking with the detachment operation of the case main body 30 from the apparatus main body 2. The remaining of the toner (the catching of the toner) between the discharge port shutter 52 at the closing state and the film 54 is inhibited so that it becomes possible to prevent an inside of the apparatus main body 2 from being contaminated with the remained toner when the case main body 30 is detached from the apparatus main body 2.

Figure 10A:
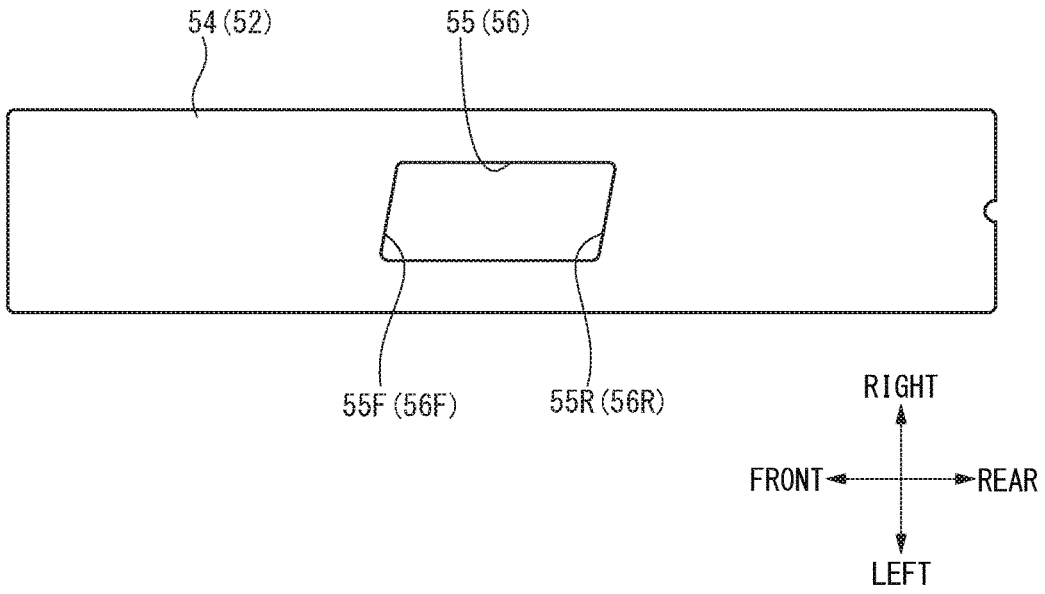
FIG. 10A and FIG. 10B are bottom views each showing a mount side opening formed in a film of a toner container according to a modified example of the embodiment of the present disclosure.
Figure 10B:
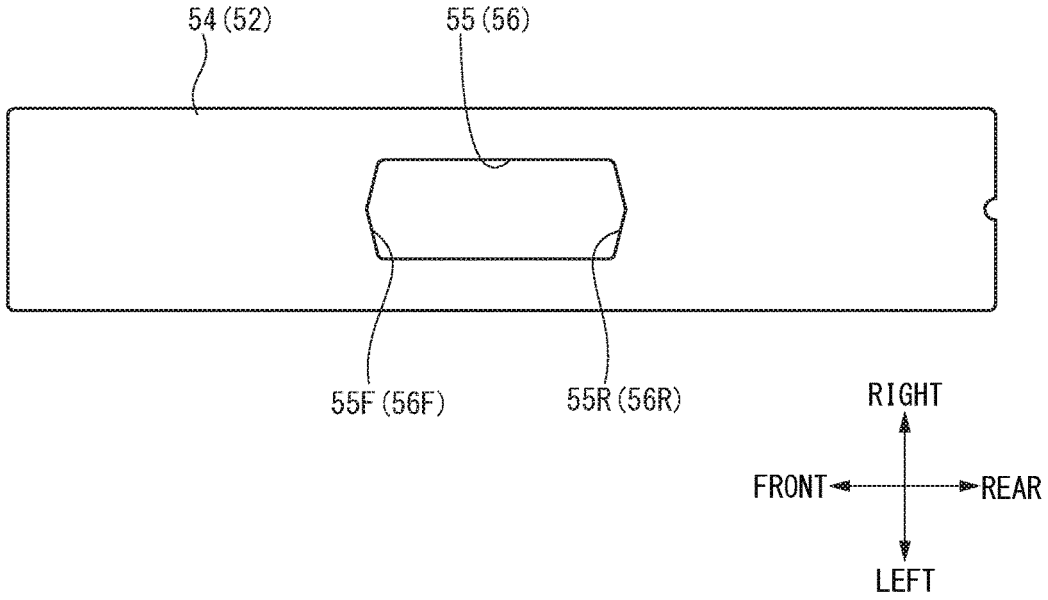

In the toner container 15 according to the present embodiment, the mount side opening 55 of the film 54 and the shutter side opening 56 of the discharge port shutter 52 each are formed into a substantially rectangular shape. However, the disclosure is not limited to the present embodiment. As the toner container 15 according to a modified example, the front and rear side edge portions 56F and 56R of the shutter side opening 56 or the front and rear side edge portions 55F and 55R of the mount side opening 55 may be formed so as to be inclined with respect to the moving direction (the front and rear direction) of the discharge port shutter 52. For instance, the mount side opening 55 (or the shutter side opening 56) may be formed into a parallelogram (refer to FIG. 10A) or a hexagon (refer to FIG. 10B), as viewed from its bottom face. At least the rear side edge portion 55R of the front and rear side edge portions of the mount side opening 55 (or at least the front side edge portion 56F of the front and rear side edge portions of the shutter side opening 56) may be inclined. That is, the edge portions of the openings 55 and 56 which come into sliding contact with each other may be formed so as to be inclined.

According to the toner container 15 according to the modified example of the present embodiment, because the front and rear edge portions 55F and 55R of the mount side opening 55 are inclined with respect to the moving direction of the discharge port shutter 52, the rear side edge portion 55R of the mount side opening 55 and the front side edge portion 56F of the shutter side opening 56 do not come into sliding contact with each other at the same time in an entire area in a width direction (the left and right direction) perpendicular to the moving direction of the discharge port shutter 52, for example. That is, the discharge port 50 is closed gradually in the width direction as the discharge port shutter 52 slides. Thereby, it becomes possible to smooth the sliding of the discharge port shutter 52 in a direction toward the closing state and to inhibit the catching of the toner more effectively.

The toner container 15 of the present embodiment (including the modified example) may be applied to an image forming apparatus which performs an image forming processing using a two-component developer including a toner and a carrier.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body containing a toner to be replenished to a development device provided in an apparatus main body, the case main body being detachably attached to the apparatus main body and including an opened face on which a discharge port is arranged, the discharge port corresponding to a replenishment port of the development device in a state where the case main body is attached to the apparatus main body;

a shutter mount provided so as to form a gap between the opened face of the case main body and the shutter mount; and a shutter provided between the opened face of the case main body and the shutter mount so as to be slidable to open and close the discharge port, wherein the shutter mount includes:

a film which comes into sliding contact with the shutter; and a mount frame part provided along the opened face of the case main body so as to surround the discharge port, and the film is fixed to the mount frame part.

2. The toner case according to claim 1, wherein the shutter is movable between an opening position where the shutter opens the discharge port and a closing position where the shutter closes the discharge port, the shutter having a shutter side opening facing the discharge port in a state where the shutter is moved to the opening position, the film having a mount side opening facing the shutter side opening in the state where the shutter is moved to the opening position, wherein when the shutter is moved between the opening position and the closing position, an edge portion of the shutter side opening comes into sliding contact with an edge portion of the mount side opening, the edge portion of the shutter side opening or the edge portion of the mount side opening is formed so as to be inclined with respect to a moving direction of the shutter.

3. The toner case according to claim 1, wherein the shutter opens the discharge port by linking with an attachment operation of the case main body to the apparatus main body and closes the discharge port by linking with a detachment operation of the case main body from the apparatus main body.

4. The toner case according to claim 1, wherein the case main body includes:

a case containing the toner and having an opening on an upper face of the case; and a lid covering the opening of the case, wherein the case has a connecting flange portion around a circumferential upper end of the case and a lower face of the connecting flange portion forms the opened face of the case main body.

5. An image forming apparatus comprising:

the toner case according to claim 1; and the development device including a housing which contains the toner replenished from the toner case, wherein the development device is replenished with the toner from the toner case so as to fill an inside of the replenishment port with the toner and keeps an amount of the toner contained in the housing constant.

6. An image forming apparatus comprising the toner case according to claim 1.

7. A toner case comprising:

a case main body containing a toner and including an opened face on which a discharge port is arranged;

a shutter mount provided so as to form a gap between the opened face of the case main body and the shutter mount; and a shutter provided between the opened face of the case main body and the shutter mount so as to be slidable to open and close the discharge port, wherein the shutter mount includes:

a film which comes into sliding contact with the shutter; and a mount frame part provided along the opened face of the case main body so as to surround the discharge port, and the film is fixed to the mount frame part.

8. An image forming apparatus comprising the toner case according to claim 7.

9. A toner case comprising:

a case main body containing a toner and including an opened face on which a discharge port is arranged;

a shutter mount provided so as to form a gap between the opened face of the case main body and the shutter mount; and a shutter provided between the opened face of the case main body and the shutter mount so as to be slidable to open and close the discharge port, wherein the shutter mount includes a film which comes into sliding contact with the shutter, wherein the film is arranged outside the discharge port and the shutter, and the shutter is arranged so as to slide on an upper face of the film.

10. An image forming apparatus comprising the toner case according to claim 9.

* * * * *